US009533528B2

(12) United States Patent
Osano et al.

(10) Patent No.: US 9,533,528 B2
(45) Date of Patent: Jan. 3, 2017

(54) BALLPOINT PEN

(71) Applicant: MITSUBISHI PENCIL COMPANY, LIMITED, Tokyo (JP)

(72) Inventors: Yoshihisa Osano, Yokohama (JP); Yoshihide Ishii, Yokohama (JP); Misao Ooyama, Yokohama (JP); Saki Hanatani, Fujioka (JP)

(73) Assignee: MITSUBISHI PENCIL COMPANY, LIMITED, Tokyo (JP)

( * ) Notice: Subject to any disclaimer, the term of this patent is extended or adjusted under 35 U.S.C. 154(b) by 81 days.

(21) Appl. No.: 14/476,960

(22) Filed: Sep. 4, 2014

(65) Prior Publication Data

US 2015/0078803 A1 Mar. 19, 2015

(30) Foreign Application Priority Data

Sep. 6, 2013 (JP) ..... 2013-185298

(51) Int. Cl.

| | |
|---|---|
| ***B43K 7/10*** | (2006.01) |
| ***B43K 1/08*** | (2006.01) |
| ***B43K 7/00*** | (2006.01) |
| ***B43K 7/08*** | (2006.01) |

(52) U.S. Cl.

CPC ..... *B43K 1/082* (2013.01); *B43K 1/084* (2013.01); *B43K 7/00* (2013.01); *B43K 7/08* (2013.01); *B43K 7/105* (2013.01)

(58) Field of Classification Search

CPC ..... B43K 7/08; B43K 1/084; B43K 7/105; B43K 7/00; B43K 1/08; B43K 7/10

USPC ..... 401/210–234

See application file for complete search history.

(56) References Cited

U.S. PATENT DOCUMENTS

| | | | | |
|---|---|---|---|---|
| 4,145,148 | A * | 3/1979 | Fukuoka | B43K 7/105 401/199 |
| 4,621,936 | A * | 11/1986 | Hansson | C04B 35/486 401/215 |
| 5,629,363 | A * | 5/1997 | Abber | B43K 1/082 401/215 |
| 6,299,376 | B1 * | 10/2001 | Nakatani | B43K 1/082 401/209 |
| 6,422,776 | B1 * | 7/2002 | Nakatani | B43K 1/084 401/209 |
| 7,303,351 | B2 * | 12/2007 | Furukawa | B29C 65/64 156/272.2 |

(Continued)

FOREIGN PATENT DOCUMENTS

| | | |
|---|---|---|
| JP | 59-135195 A | 8/1984 |
| JP | 2001-80260 A | 3/2001 |

*Primary Examiner* — Mark A Laurenzi
*Assistant Examiner* — Thomas M Abebe
(74) *Attorney, Agent, or Firm* — Westerman, Hattori, Daniels & Adrian, LLP

(57) ABSTRACT

A ballpoint pen 10 includes: a ballpoint pen tip 20 having a writing ball 30 and a holder 21 holding the writing ball 30; a shaft tube 12 to which the rear end part of the ballpoint pen tip 20 is mounted; and ink 40 accommodated in the shaft tube 12. The holder 21 has an ink guiding hole 26 formed from the rear end thereof toward the head end thereof and a ball house 22 formed with the inner circumference near the head end of the holder 21 expanded. The writing ball 30 is formed of a zirconia sintered body with the content of an aluminum element being less than 0.1 weight %, and the ink 40 contains inorganic particles 41.

5 Claims, 5 Drawing Sheets

(56) References Cited

U.S. PATENT DOCUMENTS

| | | | | |
|---|---|---|---|---|
| 8,430,591 | B1 * | 4/2013 | Okamoto | B43K 7/02 401/215 |
| 2005/0186017 | A1 * | 8/2005 | Brandstein | B43K 1/082 401/215 |
| 2007/0196160 | A1 * | 8/2007 | Nakatani | B43K 1/082 401/215 |
| 2012/0039663 | A1 * | 2/2012 | Ishii | B43K 1/08 401/209 |
| 2012/0328356 | A1 * | 12/2012 | Ishii | B43K 1/084 401/216 |
| 2015/0078803 | A1 * | 3/2015 | Osano | B43K 7/08 401/215 |
| 2015/0298488 | A1 * | 10/2015 | Masuda | B43K 7/02 401/209 |

* cited by examiner

Fig. 3A Example 1
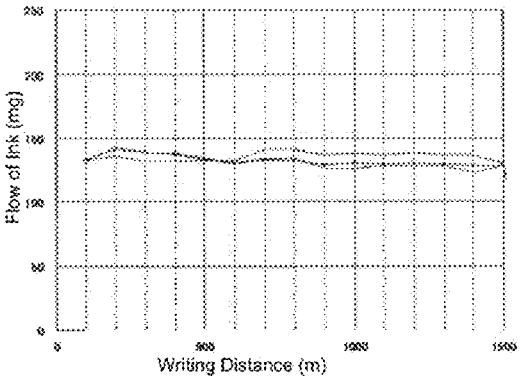
Fig. 3B Example 2
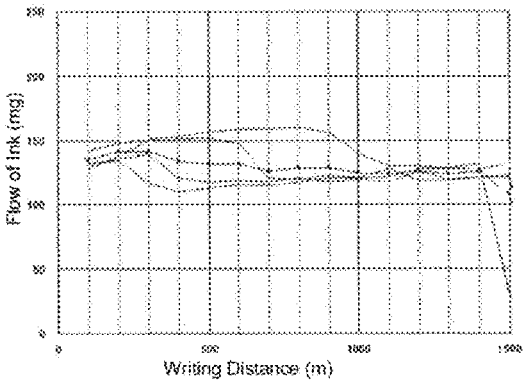
Fig. 3C Comparative Example 1
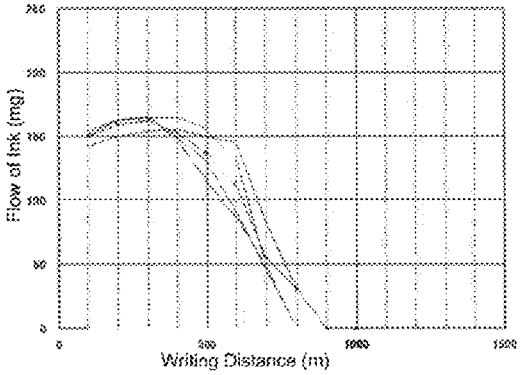
Fig. 3D Comparative Example 2
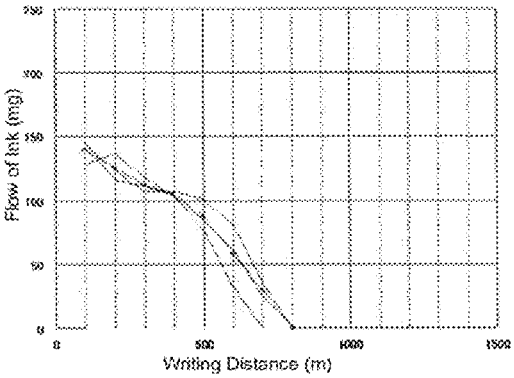
Fig. 3E Comparative Example 3
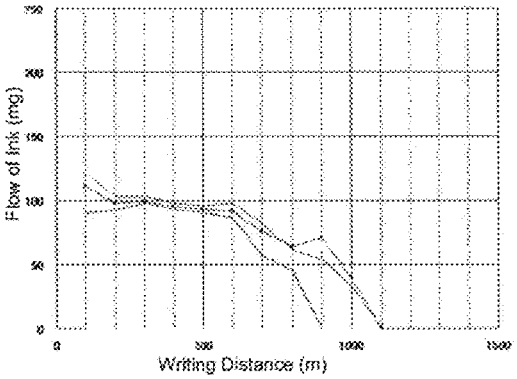

Fig. 4A Example 1
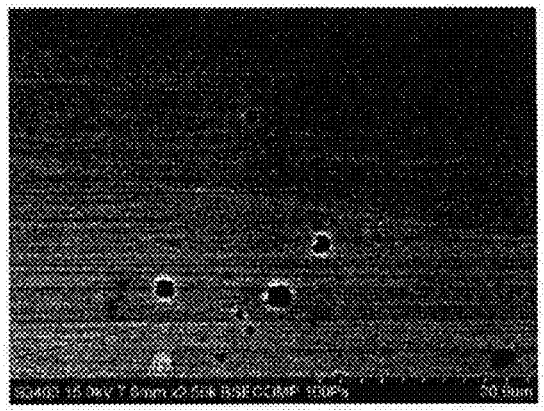
Fig. 4B Example 2
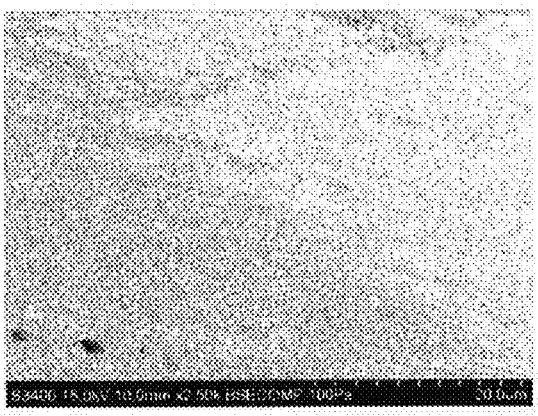
Fig. 4C Comparative Example 1
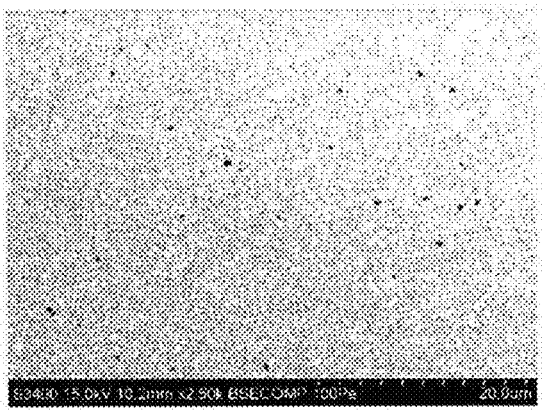
Fig. 4D Comparative Example 2
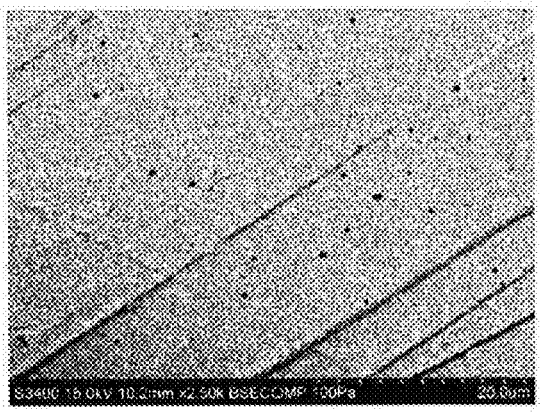
Fig. 4E Comparative Example 3
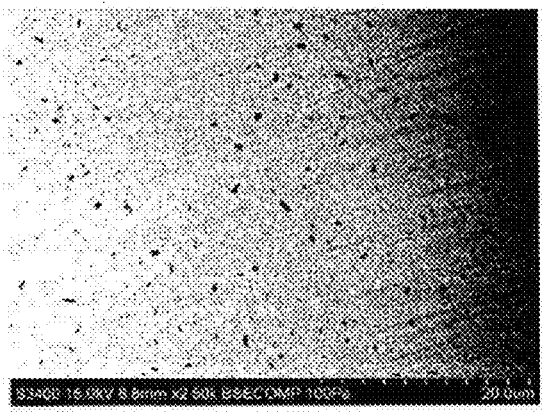

Fig. 5A Example 1
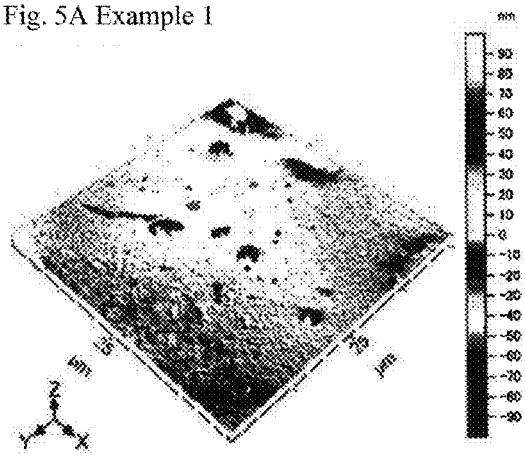
Fig. 5A Example 2
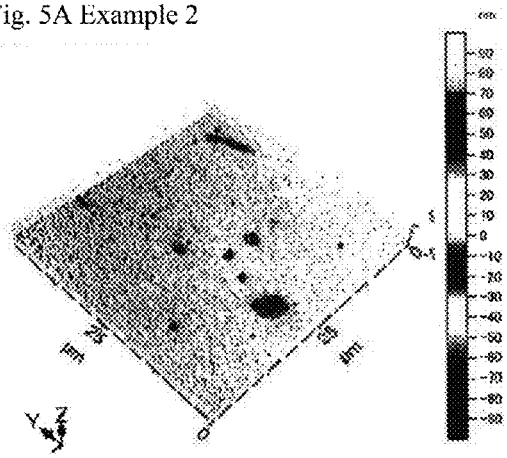
Fig. 5C Comparative Example 1
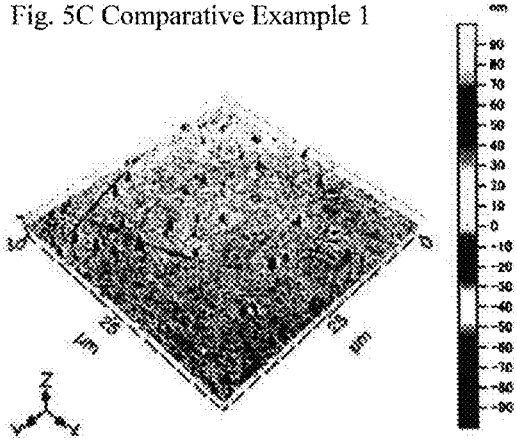
Fig. 5D Comparative Example 2
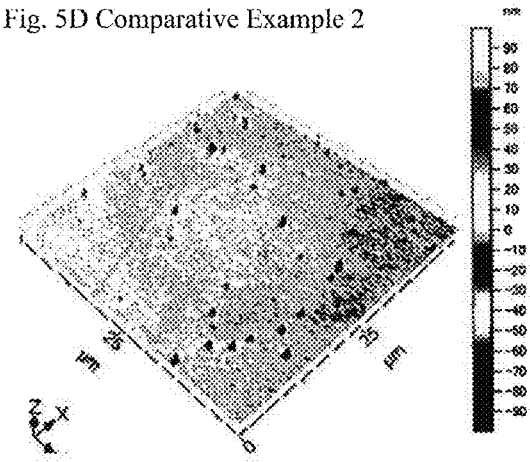
Fig. 5E Comparative Example 3
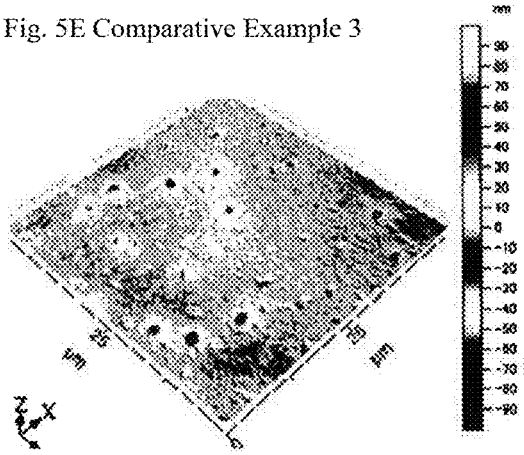

BALLPOINT PEN

TECHNICAL FIELD

The present invention relates to a ballpoint pen with a writing ball made of a zirconia sintered body.

BACKGROUND ART

Although a cemented carbide alloy has conventionally been used as a writing ball for a ballpoint pen, a writing ball made of ceramics has also been used in recent years. The writing ball made of ceramics is less susceptible to corrosion caused by ink and has a feature that there is little wear to a ball receiving seat. For example, JP 59-135195 A discloses a writing ball made of zirconia sintered body ceramics. Moreover, JP 2001-80260 A discloses a writing ball made of a zirconia sintered body, as one of writing balls suitable for ink containing hard inorganic pigment.

In the writing ball described in JP 2001-80260 A, spaces between hard grains composing the writing ball are much narrower if compared with a conventional cemented carbide alloy ball. Therefore, since the fragments of the hard grains exposed on the surface of binder metal combining the hard grains are minute and since the number of the fragments is very small, it is less likely that the fragments will drop from the surface of the writing ball and act as abrasives during writing, preventing the wear of a ball receiving seat. Moreover, since the distances between boundaries of the hard grains are narrow, the edges of the hard grains of the boundaries are less likely to act as cutting blades, preventing wear to a ball receiving seat.

SUMMARY OF INVENTION

Technical Problem

However, some zirconia sintered body ceramics contain alumina in order to improve endurance and wear resistance. When writing is performed with a ballpoint pen in which a zirconia sintered body containing alumina is used as a writing ball, a new technical problem occurred that wear to a ball receiving seat occurs and writing becomes impossible, although hard grains are less likely to act as abrasives and also to act as cutting blades because there are almost no spaces between hard grains unlike in a cemented carbide alloy ball.

The present invention is devised to solve the aforementioned problem. The object of the invention is to provide a ballpoint pen with a zirconia ball, which reduces wear to a ball receiving seat and can maintain a good writing condition for a long period of time.

Solution to Problem

Each aspect of the invention is devised to solve the aforementioned problems and is characterized below.

Numerals are ones used in the embodiments of the invention, and do not limit the technical scope of the present invention.

(First Aspect of the Invention)

In a first aspect of the present invention, a ballpoint pen 10 comprises a ballpoint pen tip 20 having a writing ball 30 and a holder 21 holding the writing ball 30; a shaft tube 12 to which the rear end part of the ballpoint pen tip 20 is mounted; and ink 40 accommodated in the shaft tube 12. The ballpoint pen 10 is characterized in that the holder 21 has an ink guiding hole 26 formed from the rear end thereof toward the head end of the holder 21 and a ball house 22 formed with the inner circumference near the head end of the holder 21 expanded, and in that the writing ball 30 is formed of a zirconia sintered body with the content of an aluminum element being less than 0.1 weight %, and in that the ink 40 contains inorganic particles 41.

When writing is performed using the ballpoint pen 10 that includes the writing ball 30 having the content of the aluminum element, which composes alumina, of 0.1 weight % or more, and the ink 40 in which the inorganic particles 41 are blended, a ball surface 31 is worn down by the inorganic particles 41 and alumina particles may be exposed as convex parts. Since the bottom face of ball house 22, which has relatively low hardness, is worn down by these convex parts, the writing ball 30 blocks ink grooves 25. As a result, the outflow of the ink 40 is obstructed and writing becomes impossible before the ink 40 is exhausted.

According to the present invention, when the content of the aluminum element, which composes the alumina in the writing ball 30, is less than 0.1 weight %, the alumina particles are not exposed on the ball surface 31 as the convex parts and the bottom face of the ball house 22 is not worn down by the convex parts, even if the inorganic particles 41 are blended in the ink 40. Therefore, since the writing ball 30 does not block the ink grooves 25 and since the flow of the ink 40 does not decrease, a good writing condition can be maintained for a long period of time.

(Second Aspect of the Invention)

In a second aspect of the present invention, in addition to the characteristics of first aspect of the invention, the inorganic particles 41 are selected, at least, from carbon black, alumina, boron nitride or titanium oxide.

When the content of the aluminum element, which composes the alumina in the writing ball 30, is 0.1 weight % or more, the ball surface 31 is worn down by the inorganic particles 41, if carbon black, alumina, boron nitride or titanium oxide is selected as the inorganic particles 41. Further, since the alumina particles are exposed on the ball surface 31 as the convex parts, the bottom face of the ball house 22 is worn down markedly by the convex parts.

According to the present invention, on the other hand, when the content of the aluminum element in the writing ball 30 is less than 0.1 weight %, a good writing condition can be maintained for a long period of time in a similar manner to the first aspect of the invention, even if the inorganic particles 41 are carbon black, alumina, boron nitride or titanium oxide.

The inorganic particles 41 mentioned herein also include composite particles in which the surfaces of organic particles, i.e. mother particles, are reformed into inorganic fine particles using a surface reforming device or the like.

(Third Aspect of the Invention)

In a third aspect of the present invention, in addition to the characteristics of the first aspect of the invention, dark color regions derived from alumina are not observed when the surface or the cross section of the writing ball 30 is observed with a scanning electron microscope.

When the content of the aluminum element is less than 0.1 weight %, the dark color regions of alumina are not recognized in an observation mode by the scanning electron microscope. Accordingly, when the dark color regions of alumina are not observed, it can be confirmed that the convex parts of alumina particles do not occur, with no need of the composition analysis of the writing ball 30. Further, when the convex parts do not occur, the bottom face of the ball house 22 is not worn down and the writing ball 30 does not block the ink grooves 25 and the ink guiding hole 26; since the flow of the ink 40 does not decrease, a good writing condition can be maintained for a long period of time.

(Fourth Aspect of the Invention)

In a fourth aspect of the present invention, in addition to the characteristics of the first aspect of the invention, the convex parts derived from alumina are not observed on the surface of the writing ball 30 when writing is finished.

That is, when writing is finished, if the convex parts of alumina particles are not observed on the surface of the writing ball 30, the bottom face of the ball house 22 is not worn down and the writing ball 30 does not block the ink grooves 25 and the ink guiding hole 26; since the flow of the ink 40 does not decrease, a good writing condition can be maintained for a long period of time.

(Fifth Aspect of the Invention)

In a fifth aspect of the present invention, in addition to the characteristics of the first aspect of the invention, the holder 21 has a ball receiving seat 24 provided on the bottom of the ball house 22 and formed around the ink guiding hole 26, and a plurality of the ink grooves 25 which arranged equidistantly around the periphery of the ink guiding hole 26 so as to connect the ball receiving seat 24 and the ink guiding hole 26.

With the ball receiving seat 24 provided, the wear of the bottom face of the ball house 22 caused by the rotation of the writing ball 30 can be prevented more effectively. Moreover, with the ink grooves 25 provided, a stable flow can be obtained.

Advantageous Effects of Invention

Since the present invention is composed as mentioned above, when writing is performed in combination with ink containing hard inorganic particles, the convex parts of hard alumina particles are not exposed, even if the entire surface of a ball is worn down by hard pigment. Therefore, the bottom face of a ball house or a ball receiving seat is not worn down by the convex parts. Further, since a writing ball does not block ink grooves and since the flow of ink does not decrease, there can be provided a ballpoint pen which can maintain a good writing condition for a long period of time.

BRIEF DESCRIPTION OF DRAWINGS

FIGS. 3A and 3B are graphs showing a relationship between a writing distance and the flow of ink in a mechanical writing test for Examples. FIGS. 3C, 3D and 3E are graphs showing a relationship between a writing distance and the flow of ink in a mechanical writing test for Comparative Examples.

FIGS. 4A and 4B are cross-sectional images of a writing ball, which were taken by a scanning electron microscope for the Examples. FIGS. 4C, 4D and 4E are cross-sectional images of a writing ball, which were taken by the scanning electron microscope for the Comparative Examples.

FIGS. 5A and 5B are views showing the state of a ball surface after writing is finished or after writing becomes impossible for the Examples. FIGS. 5C, 5D and 5E are views showing the state of a ball surface after writing is finished or after writing becomes impossible for the Comparative Examples.

DESCRIPTION OF EMBODIMENT

An embodiment of the present invention will be described below with reference to the drawings.

(1) Ballpoint Pen 10

Figure 1:
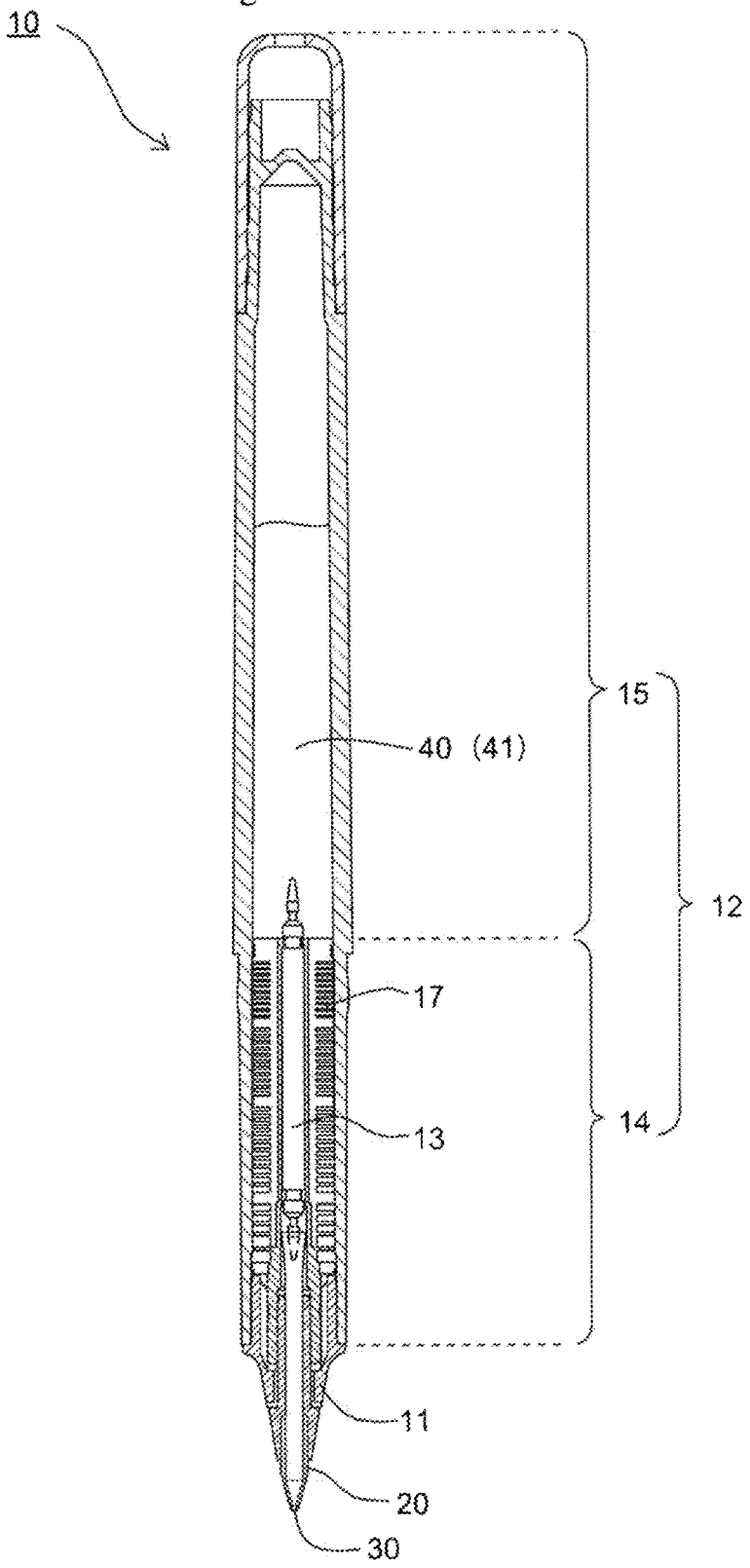
FIG. 1 is a front cross-sectional view showing a ballpoint pen according to the embodiment of the present invention.

A ballpoint pen 10 according to this embodiment is like one illustrated in FIG. 1. The ballpoint pen 10 comprises: a cylindrical shaft tube 12, the head end of which is opened and the rear end of which is closed; a ballpoint pen tip 20 mounted on the head end of the shaft tube 12 via a joint 11; an ink guiding part 13 which penetrates the shaft center of a collector storing part 14 corresponding to a front half portion of the internal space of the shaft tube 12; ink 40 which is in a direct liquid state and which is accommodated in the internal space of an ink accommodating part 15 corresponding to a rear half portion of the internal space of the shaft tube 12; and a cap (not shown), which performs capping from the point of the ballpoint pen tip 20 to the vicinity of the rear end of the collector storing part 14.

In a space from the inner face of the collector storing part 14 to the outer face of the ink guiding part 13 is formed a collector 17 in which ring-shaped thin plates are repeated in an axial direction. The collector 17 is intended to retain the ink 40 and to prevent the ink from leaking to the exterior when the air in the ink accommodating part 15 expands due to the change of an atmospheric pressure or temperature in a direct liquid type ballpoint pen.

The ink 40 may not be supplied in a direct liquid type method, but may be supplied in a cotton pad type one. Moreover, the ink accommodating part 15 may not be provided in the shaft tube 12 itself, but a separate ballpoint pen refill may be internally mounted.

Figure 2:
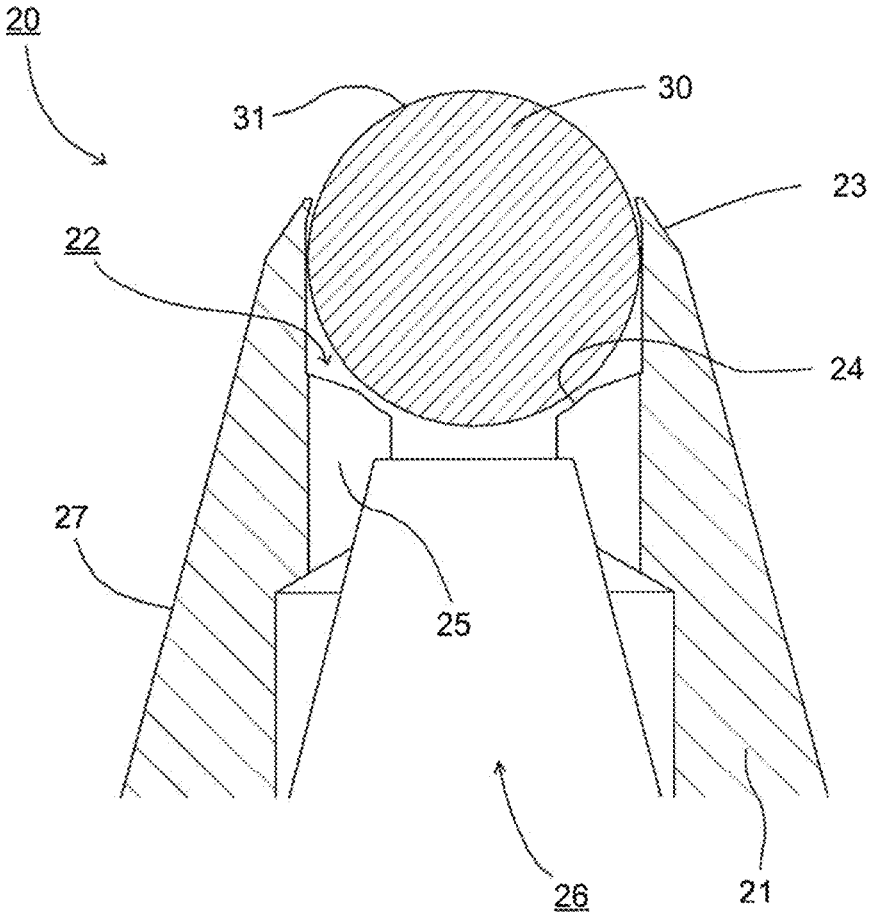
FIG. 2 is an enlarged front cross-sectional view showing the vicinity of a pen-tip's point in the ballpoint pen according to the embodiment of the present invention.

FIG. 2 is an enlarged cross-sectional view showing the vicinity of the point of the ballpoint pen tip 20. The ballpoint pen tip 20 comprises a holder 21 having a cylindrical body (not shown) and a tapered part 27 so formed that the diameter of the tapered part 27 may decrease from the head end of this body toward the point of the ballpoint pen tip 20, and a spherical writing ball 30 held inside the holder 21. Moreover, the holder 21 comprises an ink guiding hole 26 which is penetrated from the rear end of the ballpoint pen tip 20, a ball house 22 which is formed by cutting and expanding the inner circumference near the head end of the holder 21, and a narrowed part 23 which is a part sandwiched between the head end of the inner circumference face of the ball house 22 and the head end of the tapered part 27 and which is narrowed through a plastic deformation of the writing ball 30 toward a central direction. Moreover, the holder 21 has a ball receiving seat 24, which is provided on the bottom of the ball house 22 and which is formed around the ink guiding hole 26, and four ink grooves 25 which are placed equidistantly around the ink guiding hole 26 so as to connect the ball receiving seat 24 and the ink guiding hole 26. The widths and the number of the ink grooves 25 may be varied according to the viscosity coefficient etc. of the ink 40.

When the holder 21 is assembled, the writing ball 30 is inserted into the ball house 22 from the head end of the holder 21. Further, by pressing the upper part of the writing ball 30 in the direction of the rear end, the ball receiving seat 24 is deformed along the external form of the ball 30. After that, by applying narrowing processing to the head end of the tapered part 27 using a tapered roller in order to provide the narrowed part 23, the holder 21 is thus formed.

This holder 21 is formed of stainless steel with a Vickers hardness of about 200 to 420. Although the holder 21 can be formed using a metal material such as nickel silver or brass, or a resin material, it is desirable that the Vickers hardness is in a range from 170 to 450. The measurement of Vickers hardness is based on a Japanese standard called "JIS Z2244 Vickers hardness test and test method".

Furthermore, although the holder 21 is formed using cutting processing from a solid wire rod in this embodiment, processing is not limited to the cutting processing from the wire rod, but the holder 21 may be formed by using the plastic processing of a hollow-shaped pipe material, for example.

(2) Writing Ball 30

The writing ball 30 of this embodiment is formed by mixing $Y_2O_3$ or CaO, etc. as a stabilizer into zirconia ($ZrO_2$) powder. The powder, for the writing ball 30, composed of the above raw materials is kneaded and sintering is performed after the powder is formed into a substantially spherical shape. Further, this spherical body is rolled together with diamond powder between two grindstones held at a predetermined interval, and a ball surface 31 is finished to a mirror surface. The Vickers hardness of this ball surface 31 is 1,100.

It is desirable that the Vickers hardness of the ball surface 31 is in a range from 1,000 to 1,500.

Whether the writing ball 30 contains alumina or not can be determined by observing the surface or the cross section of the writing ball 30 with a scanning electron microscope. Since obtained contrast depends on an atomic number in an image observed by the scanning electron microscope, alumina contained in the writing ball 30 is displayed in a dark color while most of the writing ball 30, i.e., a zirconia sintered body, is displayed in a bright color. Accordingly, the existence of alumina can be confirmed if a dark color region is observed. A required condition for this is that the dark color region is observed regardless of the magnification of the scanning electron microscope.

Moreover, when writing is finished or when writing become impossible, whether alumina is contained or not can be confirmed by conducting a measurement on the surface. When alumina is contained, convex parts caused by the exposure of alumina appear markedly.

(3) Ink 40

The ink 40 of this embodiment is water-based ink in which carbon black is blended as inorganic particles 41.

The above inorganic particles 41 are not limited to carbon black, but other hard inorganic particles like titanium oxide, etc. and a mixture with various inorganic particles may be used. Moreover, composite particles may be used, in which the surfaces of organic particles, i.e., mother particles, are covered by and reformed by inorganic fine particles by using a surface reforming device or the like. Concrete inorganic particles include alumina, boron nitride, titanium oxide, zinc white, red iron oxide, chromium oxide, iron black, cobalt blue, yellow iron oxide, viridian, zinc sulfide, lithopone, cadmium yellow, vermilion, cadmium red, chrome yellow, a molybdate orange, zinc chromate, strontium chromate, white carbon, clay, talc, ultramarine, precipitated barium sulphate, baryte powder, calcium carbonate, white lead, Prussian blue, manganese violet, aluminum powder, bronze powder, brass powder, etc.

Furthermore, with respect to the classification by the solvent of ink, ink is not limited to water-based ink, but gel ink or oil-based ink may be used. However, in the case of oil-based ink, since a boundary between both the ball receiving seat 24 and the bottom face of the ball house 22 and the ball surface 31 is always lubricated, wear to the ball receiving seat 24 and the bottom face of the ball house 22 is less likely to occur than in the case of water-based ink. Therefore, applying water-based ink will exhibit a greater effect of suppressing the wear of the ball receiving seat 24.

(4) Action and Effect

During writing, the ink 40 of the ink accommodating part 15 is fed to the ball house 22 through the ink guiding part 13, the ink guiding hole 26 and the ink grooves 25, and is sufficiently supplied to the writing ball 30 accommodated in the ball house 22. Further, the ink 40 supplied through the rotation of the writing ball 30 is transferred to or permeates into a recording body like a sheet of paper, etc., and writing is completed.

Here, when alumina is contained in the writing ball 30 and if the Vickers hardness of the inorganic particles 41 is greater than that of the writing ball 30, which is in a range from 1,000 to 1,500, the ball surface 31 will be worn down by continuing writing. Moreover, since the Vickers hardness of the alumina contained in the writing ball 30 is 2,000, when the Vickers hardness of the inorganic particles 41 is 2,000 or less, alumina particles are exposed as convex parts on the ball surface 31, and the convex parts will wear the ball receiving seat 24 and the bottom face of the ball house 22. Accordingly, when hard inorganic particles meeting the above Vickers hardness condition are blended in the ink 40, the ball receiving seat 24 and the bottom face of the ball house 22 are worn down by the zirconia ball containing alumina, and the writing ball 30 blocks the ink grooves 25 and the ink guiding hole 26. As a result, the flow of the ink 40 decreases rapidly, and writing becomes impossible.

In this embodiment, when the content of the aluminum element composing alumina is less than 0.1 weight %, the convex parts caused by alumina particles are not formed; even if carbon black particles, i.e., hard inorganic particles, are blended in the ink 40, the effect of preventing wear is great.

Examples

Examples of the present invention will be described below in comparison with Comparative Examples.

Five kinds of writing balls 30 were prepared, which had different alumina contents with respect to each other. They were spherically shaped zirconia balls having the diameter of 0.5 mm with the ball surface 31 processed to a mirror surface. Writing tests were performed using a mechanical writing test machine which was adapted to a Japanese standard called "JIS S6054 water-based ballpoint pen and refill". The writing ball 30 was mounted on a pen tip, Uni-ball eye (model number: UB-150) produced by Mitsubishi Pencil Co., Ltd., and watercolor pigment black ink containing carbon black was used for the ink 40. Writing test conditions were as follows.

[Writing Test Conditions]

Writing angle: 60°

Load: 1 N

Writing speed: 4.5 m/min

Writing distance: Until ink stops discharging (1500 m at most)

Test conditions other than the above followed the standard, "JIS S6054 water-based ballpoint pen and refill".

[Test Results]

The results of the above tests are shown in Table 1, and graphs presenting a relationship between a writing distance and the flow of ink are shown in FIGS. 3A to 3E. Each measured value for the flow of ink represents the quantity of ink (mg) consumed every 100-m writing.

TABLE 1

| | Examples | | Comparative Examples | | |
|---|---|---|---|---|---|
| | 1 | 2 | 1 | 2 | 3 |
| Maximum Amount of Wear of the Ball Receiving Seat (μm) | 17 | 6 | 62 | 65 | 58 |
| Writing Status | Writing Finished | Writing Finished | Writing Impossible | Writing Impossible | Writing Impossible |

From the results of Table 1 and FIG. 3, the maximum amount of wear of the ball receiving seat 24 was 17 μm for Example 1 and was 6 μm for Example 2, and the writing status was judged as "Writing Finished", indicating that writing was possible until the writing distance specified in the test conditions is reached. On the other hand, in Comparative Examples 1, 2 and 3, the maximum amount of wear of the ball receiving seat 24 was in a range from 58 to 65 μm, and the writing status was judged as "Writing Impossible", indicating that writing was finished before the specified writing distance was reached.

[Confirmation Method of Cross-Sectional Image]

Next, the cross section of the writing ball 30 was observed using a scanning electron microscope, S-3400N produced by Hitachi High-Technologies Co. The cross-sectional images are shown in FIG. 4A to 4E. The confirmation conditions of a dark color region were as follows.

Mode: Low-vacuum mode Internal pressure of chamber 50 Pa

Probe current: 60 μA

Acceleration voltage: 15 kV

Image: Reflection electron composition image

Magnification: 2000 times

Moreover, the content of the aluminum element composing alumina was measured by energy dispersive X-ray spectroscopy using an X-ray spectrometer, EMAX ENERGY EX-250 produced by HORIBA Ltd. The measured results are shown in Table 2. Measurement conditions were as follows.

Acceleration voltage: 15 kV

Magnification: 2000 times

Dead time: 20%

Analysis time: 100 seconds

TABLE 2

| | Examples | | Comparative Examples | | |
|---|---|---|---|---|---|
| | 1 | 2 | 1 | 2 | 3 |
| Aluminum Content (weight %) | Not Detected | 0.06 | 0.2 | 0.2 | 1.2 |

In the cross-sectional images of FIGS. 4A to 4E, a large number of dark color regions are observed for Comparative Examples 1, 2 and 3. When a qualitative analysis was conducted for these dark color region by energy dispersive X-ray spectroscopy, an aluminum element (Al) composing alumina was detected. Further, when the content of aluminum for each of Examples and Comparative Examples was quantitatively analyzed by energy dispersive X-ray spectroscopy, the obtained results are presented in Table 2. Aluminum was not detected for Example 1, and the content of aluminum was 0.06 weight % for Example 2. Moreover, the content of aluminum was in a range from 0.2 to 1.2 weight % for Comparative Examples. Dark color regions were observed for Example 1, but these were cavities on the ball surface 31. Moreover, aluminum was contained with the content of 0.06 weight % for Example 2, but no dark color region was observed.

[Confirmation Method of Surface Roughness Measurement]

Next, using an ultraprecise noncontact three-dimensional surface property measuring apparatus, Taly surf CCI Lite produced by Taylor Hobson Ltd., the surface state of the writing ball 30 was measured for Examples 1 and 2 and Comparative Examples 1, 2 and 3 when the writing ball 30 was in the status of "Writing Finished" or "Writing Impossible" in a continuous mechanical writing test. FIGS. 5A to 5E show the measured results of the roughness of the ball surface 31 when the writing ball was in the status of "Writing Finished" or "Writing Impossible" in the continuous mechanical writing test. It was shown that there was a greater height difference as color deepens. The deep color part of Example 1 and 2 showed a cavity corresponding to a concave part which slowly lowered from a contour part toward a center. On the other hand, the deep color parts of Comparative Examples 1, 2 and 3 corresponded to sharp convex parts. It can be confirmed that alumina particles were exposed at the sharp convex parts. The ball receiving seat 24 and the bottom face of the ball house 22 are worn down by these convex parts.

From the above results, the content of an aluminum element for the writing ball 30 of the present invention is determined to be 0.1 weight % or less in consideration of error in a quantitative analysis. When the content of the aluminum element is equal to this value or less, since alumina particles are not exposed as convex parts on the ball surface 31, the ball receiving seat 24 is not worn down. Further, since the writing ball 30 does not block the ink grooves 25 and the ink guiding hole 26 and since the flow of the ink 40 does not decrease, there can be provided a ballpoint pen, with a zirconia ball, which can maintain a good writing condition for a long period of time.

REFERENCE SIGNS LIST

10 Ballpoint pen
12 Shaft tube
14 Collector storing part
17 Collector
20 Ballpoint pen tip
22 Ball house
24 Ball receiving seat
26 Ink guiding hole
30 Writing ball
40 Ink
11 Joint
13 Ink guiding part
15 Ink accommodating part
21 Holder
23 Narrowed part
25 Ink groove
27 Tapered part
31 Ball surface
41 Inorganic particle

The invention claimed is:

1. A ballpoint pen, comprising:

a ballpoint pen tip having a writing ball and a holder holding the writing ball;

a shaft tube to which a rear end part of the ballpoint pen tip is mounted; and ink accommodated in the shaft tube, the holder having:

an ink guiding hole formed from a rear end of the holder toward a head end of the holder; and a ball house formed with an inner circumference near a head end of the holder expanded, the writing ball being formed of a zirconia sintered body with a content of an aluminum element being less than 0.1 weight %, and the ink containing inorganic particles, wherein at least some of said inorganic particles of said ink have a Vickers hardness that is larger than the Vickers hardness of the zirconia sintered body of said writing ball, and wherein dark color regions derived from alumina are not observed when a surface or a cross section of the writing ball is observed with a scanning electron microscope.

2. The ballpoint pen according to claim 1, wherein the inorganic particles are selected, at least, from carbon black, alumina, boron nitride or titanium oxide.

3. The ballpoint pen according to claim 1, wherein convex parts derived from alumina are not observed on a surface of the writing ball when writing is finished.

4. The ballpoint pen according to claim 1, wherein the holder has a ball receiving seat provided on a bottom of the ball house and formed around the ink guiding hole, a plurality of ink grooves arranged equidistantly around the ink guiding hole so as to connect the ball receiving seat and the ink guiding hole.

5. The ballpoint pen according to claim 1, wherein said content of said aluminum element is 0.06 weight % or less.

* * * * *